US005196820A

United States Patent [19]

Ubukata, deceased et al.

[11] Patent Number: 5,196,820

[45] Date of Patent: Mar. 23, 1993

[54] THERMALLY RESPONSIVE SWITCH AND METHOD OF MAKING THE SAME

[75] Inventors: Susumu Ubukata, deceased, late of Nagoya, by Shinya Ubukata, Reiko Ubukata, Shinnosuke Ubukata, legal representatives and/or heirs; Yasukazu Mizutani, Nagoya; Isao Higashikata, Owariasahi; Hideki Koseki, Owariasahi, all of Japan

[73] Assignee: Ubukata Industries Co., Ltd., Nagoya, Japan

[21] Appl. No.: 908,858

[22] Filed: Jul. 1, 1992

Related U.S. Application Data

[63] Continuation of Ser. No. 809,445, Dec. 19, 1991.

[30] Foreign Application Priority Data

Dec. 19, 1990 [JP] Japan ..... 2-412348
Apr. 3, 1991 [JP] Japan ..... 3-96377

[51] Int. Cl.[5] ..... H01H 37/12; H01H 37/54; H01H 37/00

[52] U.S. Cl. ..... 337/368; 337/3; 337/378

[58] Field of Search ..... 337/347, 349, 360, 368, 337/378, 57, 82, 93, 94, 3, 4; 29/622

[56] References Cited

U.S. PATENT DOCUMENTS 4,167,721 9/1979 Senor et al. ..... 337/112

FOREIGN PATENT DOCUMENTS 58-56213 12/1983 Japan .
62-6294 2/1987 Japan .

*Primary Examiner*—Harold Broome

[57] ABSTRACT

A thermally responsive switch includes an elliptic dome-shaped metal receptacle, a header metal plate hermetically secured to the receptacle and having a through-aperture at one of two longitudinal ends, an electrical conductor inserted through the aperture of the header plate and secured with an electrically insulating material such as glass, a support having at one of two longitudinal ends a fixed portion secured to the end of the conductor in the receptacle and a supporting portion positioned away from its other end in the direction of the fixed portion, a bimetal secured at one of its two ends to the supporting portion of the support and carrying a movable contact at the other end, the bimetal having a central shallow dish-shaped portion reversing its curvature with a snap action in response to the temperature, a fixed contact secured to the header plate in the vicinity of its other longitudinal end, and a calibrator interposed between the inner wall of the receptacle and the other end of the support opposing the movable contact. The calibrator is moved, pushing the other end of the support when the receptacle wall corresponding to the calibrator is deformed for calibration of an operating temperature of the switch, so that the support is bent in the vincity of the fixed portion such that a contact pressure between the movable and fixed contacts is varied.

8 Claims, 4 Drawing Sheets

THERMALLY RESPONSIVE SWITCH AND METHOD OF MAKING THE SAME

This application is a continuation, of application Ser. No. 07/809,445, filed Dec. 19, 1991.

BACKGROUND OF THE INVENTION

This invention relates to a thermally responsive switch suitable for protecting electric motors employed in hermetic compressors of refrigerating machines against burnout due to overheating and a method of making the same.

The motor employed in the hermetic compressor for the refrigerating machine is usually driven in a hermetically sealed compressor housing with refrigerant and lubricating oil surrounding it. Taking into consideration the maximum pressure values in low and high pressure conditions during respective compressor on and off periods, the pressure in the hermetically sealed compressor housing is varied in a vast range. The thermally responsive switch used in the above-described atmosphere is required to be reliably responsive to changes in the motor winding temperature and the current and to open an electrical path in an abnormal condition so that the motor is deenergized. In order to operate the thermally responsive switch as described above, its parts including movable and fixed contacts are enclosed in a hermetic casing so that invasion of the refrigerant or the like into the casing interior can be prevented. Furthermore, the hermetic casing of the thermally responsive switch necessitates a high level of pressure tightness, thermal responsiveness and specific characteristic of distinguishing between a normal current and an abnormal current. Additionally, the thermally responsive switch is required to be small in size, large in the switching capacity and superior in durability while it should be stable in quality and cost effective. Under these circumstances, it has become difficult to provide a thermally responsive switch meeting the above-described demands.

Conventional thermally responsive switches are disclosed in Japanese Published Patent Application (kokoku) Nos. 58-56213 and 62-6294. As obvious from the foregoing, the hermetic casing of the thermally responsive switch needs to have a sufficient pressure tightness so that the responsiveness of the device is not affected by severe temperature and pressure changes in the compressor housing. In these conventional devices, however, the increase in the pressure tightness extremely increases the wall thickness of the hermetic casing enclosing the switching assembly including a bimetallic thermally responsive element carrying a movable contact and a fixed contact engaged with and disengaged from the movable contact, resulting in a disadvantage. Furthermore, the position of the movable contact relative to the fixed contact is checked by means of X-ray irradiation after the switch receptacle is finally sealed hermetically. Thus, checking the position of the movable contact relative to the fixed contact cannot be readily performed. Additionally, the thermally responsive switch repeatedly break a motor circuit in response to an abnormal current flowing into the motor or an overtemperature and make the motor circuit when a normal current condition or a safe temperature condition is recovered. The service life of the thermally responsive switch depends largely upon the number of circuit making and breaking operations of the contacts. Heat due to an arc between the contacts melts the contact surface. Particles of melted contact material are caused to splash around to adhere to the surface of an electrical insulator insulating a portion at the same potential as a movable contact and a portion at the same potential as a fixed contact, resulting in gradual decrease in an insulation distance between the fixed and movable contacts. This decrease in the insulation distance reduces a dielectric strength, which reduction in the dielectric strength is one of important causes of shortening the life of the thermally responsive switch. Although this may be solved by increasing the insulation distance between the contacts, the increase in the insulation distance increases the dimensions of the thermally responsive switch. Furthermore, the insulator itself is required to have such a particular heat resistance that they are not broken by the heat due to the arc between the contacts.

SUMMARY OF THE INVENTION

Therefore, an object of the present invention is to provide a thermally responsive switch which has a small size, high productivity, long service life, stable quality and high cost-effectiveness and wherein the precise calibration of the operating temperature can be performed.

In accordance with the present invention, an improved thermally responsive switch comprises an elliptic dome-shaped receptacle formed of a metallic material and having a generally arc-shaped central portion, two generally hemispheric ends and an open end. A header plate formed of a metallic material is hermetically secured to the receptacle by way of welding so as to close the open end thereof such that a hermetic casing is formed by the receptacle and the header plate. The header plate has an aperture formed therethrough at one of two longitudinal ends. An electrical conductor is inserted through the aperture of the header plate so that both ends thereof are projected from both sides by predetermined dimensions respectively. The conductor is secured in the aperture with an electrically insulating material such as glass inserted between the peripheral wall surface of the aperture and the outer periphery of the conductor for hermetically sealing the enclosure in the casing. A support is disposed within the receptacle along the longitudinal direction thereof and having at one of two longitudinal ends a fixed portion secured to the end of the conductor positioned in the receptacle and a supporting portion positioned away from the other end thereof in the direction of the fixed portion. A thermally responsive element is secured at one of two ends to the supporting portion of the support and carrying a movable contact at the other end. The thermally responsive element is formed of a thermally deformable material such as a bimetal or the like and has a generally central shallow dish-shaped portion reversing its curvature with a snap action in response to an ambient temperature. A fixed contact is secured to the header plate in the vicinity of the other longitudinal end thereof for thermal conduction so as to cooperate with the movable contact. A calibrating member is interposed between the inner wall of the receptacle and the other end of the support opposing the movable contact. The calibrating member is moved, pushing the other end of the support when the receptacle wall corresponding to the calibrating member is deformed for calibration of an operating temperature of the thermally responsive switch, so that the support is bent in the vicinity of the fixed portion thereof such that a contact pressure between the movable and fixed contacts is varied.

In the conventional construction, it has been difficult to check and adjust the relative positions among the parts of the switching assembly since the thermally responsive element is secured to the receptacle itself composing the hermetic casing. In the above-described construction presented by the present invention, however, assembling the switching assembly including the thermally responsive element, movable contact and fixed contact is completed before the final step where the hermetic casing is assembled. Consequently, the relative positions among the parts of the switching assembly can be readily checked and adjusted.

The heat due to sparking between the fixed and movable contacts is absorbed by the header plate such that the fixed contact can be effectively cooled. Furthermore, the contact pair and the insulating material for securing the conductor are positioned away from each other at the opposite end sides of the header plate, which can reduce influences of the splashing particles of the contact material due to the arc between the contacts and the heat due to the arc can be reduced. In addition, the displacement of the calibrating member due to the deformation of the receptacle wall for the calibration of the switch operating temperature is exerted on the end of the thermally responsive element, which end is opposite to the substantial fulcrum of the cantilever mounted thermally responsive element. Consequently, the precise calibration of the operating temperature can be provided.

It is preferable that the support have a smaller cross sectional area at the portion in the vicinity of the supporting portion than at the other portion thereof so that an electrical resistance and a thermal resistance are rendered larger at the portion in the vicinity of the supporting portion than in the other portion. The speed at which the heat of the thermally responsive element is radiated via the support can be limited, a switch off-state period can be prolonged.

It is also preferable that an end of a terminal pin as the electrical conductor positioned inside the hermetic casing be coupled to the fixed portion of the support by an easily meltable member after the thermally responsive element is secured to the supporting portion of the support, the easily meltable member having a melting or softening temperature higher than the temperature at which the thermally responsive element is operated. Consequently, the electrical path can be permanently opened in the case of an abnormal temperature rise.

Other objects of the present invention will become obvious upon understanding of the illustrative embodiments about to be described. Various advantages not referred to herein will occur to one skilled in the art upon employment of the invention in practice.

BRIEF DESCRIPTION OF THE DRAWINGS

The invention will be described merely by way of example with reference to the accompanying drawings in which.

DESCRIPTION OF THE PREFERRED EMBODIMENTS

Figure 1:
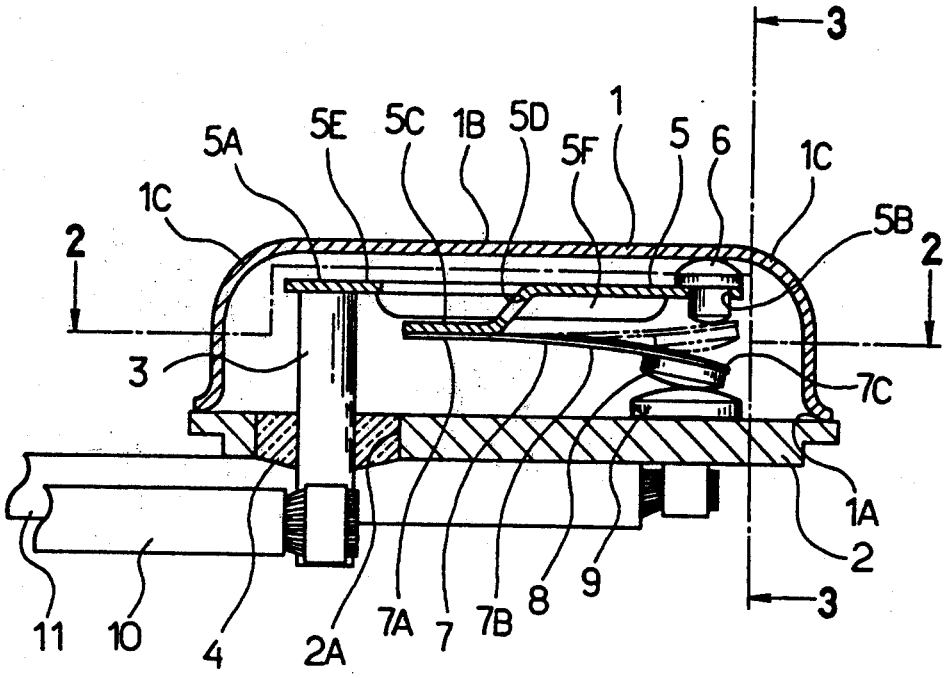
FIG. 1 is a longitudinal sectional view of the thermally responsive switch of one embodiment in accordance with the present invention.
Figure 2:
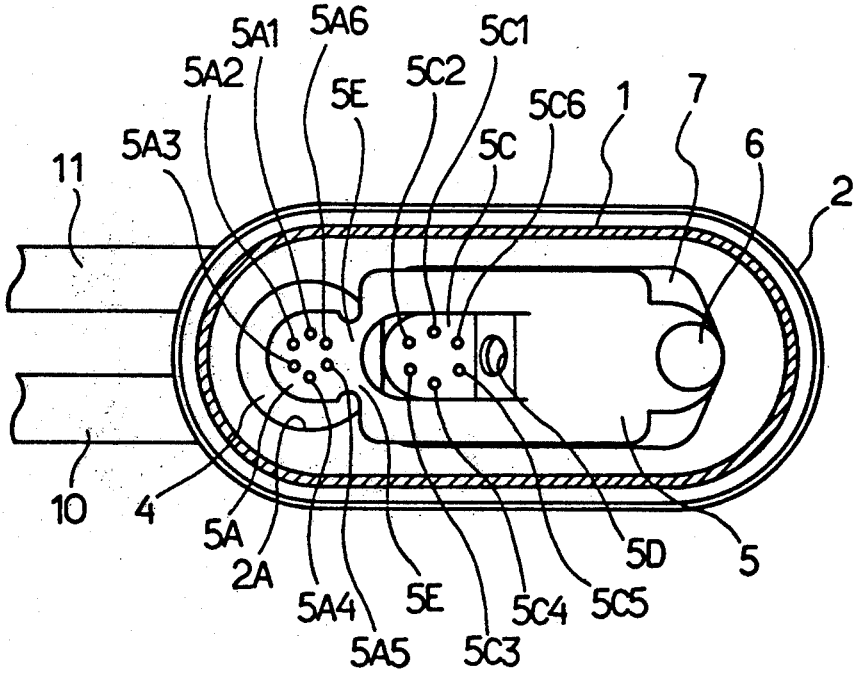
FIG. 2 is a plan view taken along line 2—2 in FIG. 1.
Figure 3:
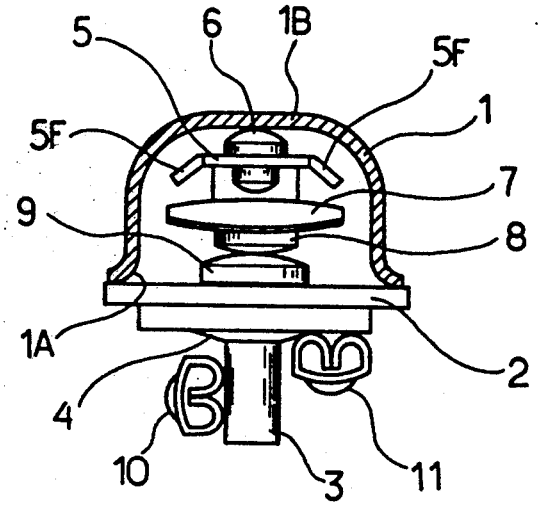
FIG. 3 is a cross sectional view taken along line 3—3 in FIG. 1.

One embodiment of the present invention will be described with reference to the drawings. Referring first to FIGS. 1 to 4, a generally elliptic shallow dome-shaped receptacle 1 of the thermally responsive switch is formed of a rolled steel sheet by way of drawing with a press and has an open end 1A. The central portion of the receptacle 1 includes a nearly circular portion 1B as best shown in FIG. 3. The receptacle 1 further includes opposite hemispheric ends 1C. A header plate 2 is secured to the receptacle 1 by way of a ring projection welding in an assembly step of hermetically sealing the switch, so as to hermetically close its open end. A hermetic casing is thus formed of the receptacle 1 and the header plate 2. The header plate 2 is formed by punching a steel sheet having a thickness larger than the receptacle 1 so that the same strength is obtained as of the elliptic shallow dome-shaped receptacle 1. The header plate 2 has a through aperture 2A formed in one of two longitudinal ends, that is, its left-hand side as viewed in FIG. 1. An electrical conductor 3 is inserted through the aperture 2A and secured in position by an electrically insulative filler 4 such as glass, ceramics or synthetic resin inserted therebetween.

When glass is employed as the filler 4, it is desirable that the conductor 3 be formed from a nickel-iron alloy in consideration of thermal expansion coefficients of the header plate 2 and the glass such that a compression type hermetic sealing is applied to the switch. The upper end of the conductor 3 extended through the aperture 2A or its end projected into the interior of the hermetic casing is secured electrically conductively by welding to the left-hand end of a support 5 for supporting a thermally responsive element 7. The support 5 has such a configuration as shown in FIG. 2 and includes a left-hand fixed portion 5A. The fixed portion 5A has, for example, six small projections 5A1 to 5A6 for the welding so as to be secured to the upper end of the conductor 3 readily and reliably. The support 5 has a small aperture 5B formed in the vicinity of its right-hand end for the purpose of positioning a calibrating member 6, as best shown in FIG. 1. The support 5 further has a supporting portion 5C formed by cutting its portion in the vicinity of the central portion and bending the cut portion in the direction of the fixed portion with a press. Six projections 5C1 to 5C6, for example, are formed in the vicinity of the left-hand end of the supporting portion 5C as best shown in FIG. 2. An aperture 5D may be formed in the supporting portion 5C if necessary so that facility for assembling the thermally responsive switch is afforded and the operating characteristics of the switch is improved, as will be described later. It is also preferable that reinforcing ribs 5F be provided so as to extend along both longitudinal sides of the support 5, as shown in FIG. 3. The calibrating member 6 is formed of an electrically insulative material such as ceramics and includes a head portion with a nearly hemispheric upper end and a portion inserted into the aperture 5B of the support 5, which portion has a diameter smaller than the head portion. It is readily understood that the configuration of the calibrating member 6 is not limited to that shown and described. The calibrating member 6 may take other configurations for the purpose of insulatively transmitting displacement of the receptacle 1 to the right-hand end of the support 5, as viewed in FIG. 1.

A thermally responsive element 7 is formed of a metal sheet deforming in response to the temperature change such as bimetal or trimetal. The metal sheet is punched into a strip and the central portion of the strip is drawn into a shallow dish-shaped portion 7B so that the element 7 snaps in response to the temperature change. The projections 5C1–5C6 are melted so that the left-hand end 7A of the thermally responsive element 7 is secured by welding to the supporting portion 5C of the support 5. A movable contact 8 is secured by welding to the right-hand end 7C of the thermally responsive element 7. The movable contact 8 has a contact surface formed of silver or a silver alloy. A fixed contact 9 is secured by welding to the vicinity of the right-hand end of the header plate 2 as viewed in FIG. 1, that is, the other longitudinal end of the header plate 2 opposite to the conductor 3.

In assembling the above-described thermally responsive switch, the conductor 3 is inserted through the aperture 2A of the header plate 2 and centrally secured by a filler 4 inserted between the conductor 3 and the periphery of the aperture 2A for hermetically sealing parts in the casing. The fixed contact 9 is then secured to the header plate 2. The end of the thermally responsive element 7 opposite to the end carrying the movable contact 8 is secured to the supporting portion 5C of the support 5. The fixed end 5A of the support 5 is then secured to the conductor 3. In this condition, the calibrating member 6 is inserted through the aperture 5B formed in the vicinity of the free end of the support 5. Subsequently, the movable and fixed contacts 8, 9 are checked as to whether or not the movable contact 8 is in slight contact with the fixed contact 9 or faces it with a extremely small gap therebetween. Then, it is checked whether or not the distance D (FIG. 4) between the upper surface of the thermally responsive element 7 and the lower surface of the calibrating member 6 is within a predetermined dimensional tolerance. A too large distance D increases an arc induced at the time contact is made and broken between the movable and fixed contacts 8, 9. A too small distance D is not also preferable. It needs to be taken into consideration that the distance D is slightly reduced as the result of execution of the work for calibrating the operating temperature as will be described later. Furthermore, the depth of the receptacle 1 is reduced when welded to the header plate 2. In consideration of this receptacle depth reduction, it is checked whether a slight space is between the inner wall of the receptacle 1 and the upper surface of the calibrating member 6 or in slight contact with it. The receptacle 1 is hermetically secured to the header plate 2 only after the above-described conditions are met. In case that the above-described conditions are not met, the portion 5E of the support 5 having a smaller width and the root portion of the supporting portion 5C are deformed so that the above-described conditions are met. Then, the receptacle 1 is hermetically secured to the header plate 2. In this case the bending can be performed with ease when the aperture 5D is formed in the vicinity of the root portion of the supporting portion 5C.

Figure 4:
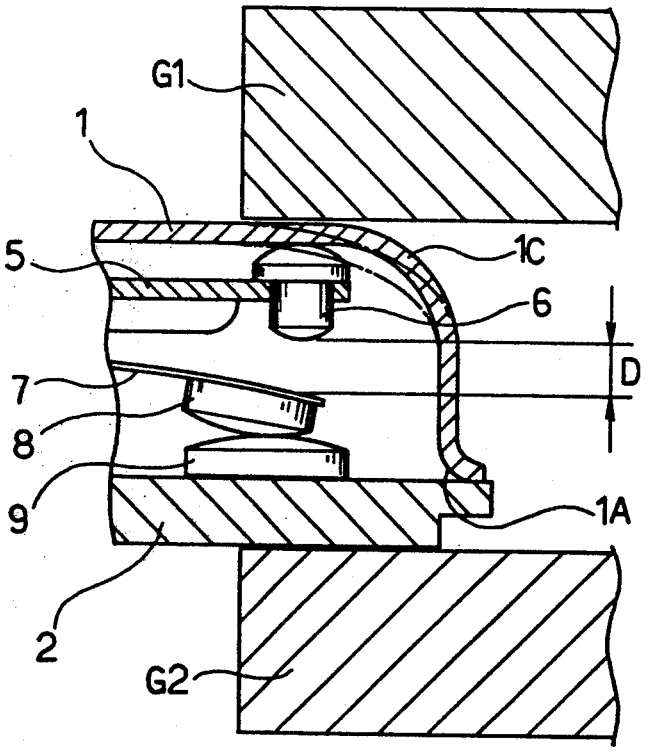
FIG. 4 is a partial longitudinal section of the thermally responsive switch for explaining an operating temperature calibrating work.

Upon completion of assembling the hermetic casing, the receptacle 1 and the header plate 2 are held between jigs G1 and G2 as shown in FIG. 4. In this condition the portion of the receptacle 1 corresponding to the calibrating member 6 is pressed as shown by dotted line in FIG. 4 such that the thermally responsive element 7 reverses its curvature with snap action at a predetermined temperature as shown by dotted line in FIG. 1. Consequently, the portion 5E of the support 5 in the vicinity of the fixed portion 5A is bent downwardly so that the thermally responsive element 7 is displaced in the clockwise direction as viewed in FIG. 1. Thus, the contact pressure between the movable and fixed contacts 8, 9 is increased, whereby occurrence of chattering can be prevented when the thermally responsive element 7 reverses its curvature with snap action at the predetermined temperature so that the movable contact 8 is disengaged from the fixed contact 9, and furthermore, the thermally responsive switch is calibrated so as to be set to the predetermined operating temperature.

In the thermally responsive switch constructed as described above, the thermally responsive element 7 reverses its curvature with snap action in an atmosphere at a predetermined temperature, for example, at 150° C. as shown by the dotted line in FIG. 1, thereby disengaging the movable contact 8 from the fixed contact 9. When the atmospheric temperature is decreased to the value of 80° C., for example, the thermally responsive element 7 again reverses its curvature with the snap action to the former state as shown by the solid line in FIG. 1, so that the movable contact 8 is engaged with the fixed contact 9. Lead wires 10 and 11 are connected to the conductor 3 and the header plate 2 respectively so that the thermally responsive switch is connected via the lead wires in series to a circuit for supplying current to a motor (not shown), as shown in FIGS. 1–3. Although a large current flows through the circuit at the time of starting of the motor, the current takes a rated value when the motor begins to run normally after starting. Consequently, the temperature of the thermally responsive element is not raised to the predetermined operating temperature during the motor starting such that the thermally responsive switch is not operated. The current flowing into the thermally responsive switch passes through the lead wire 10, conductor 3, support 5, thermally responsive element 7, movable contact 8, fixed contact 9, header plate 2 and lead wire 11 in sequence. When the temperature of the thermally responsive element 7 is raised to 150° C. under the influence of heat due to resistance of this circuit, the thermally responsive element 7 reverses its curvature with the snap action to disengage the movable contact 8 from the fixed contact 9 as shown by dotted line in FIG. 1, thereby cutting off the current supplied to the motor. An arc is induced between the movable and fixed contacts 8, 9 on this occasion and the resultant heat and Joule's heat melt parts of the movable and fixed contacts 8, 9. Particles of the melted parts splash from between the contacts. Deterioration gradually progresses in the insulator when some of the particles reach the surface of the filler 4 insulating the contacts from each other, and the life of the insulator terminates in due course of time. However, since the fixed contact 9 engaged with the movable contact 8 and the filler 4 are positioned at the respective opposite end sides of the header plate 2, the distance between the contact 9 and the filler 4 can be sufficiently increased in the longitudinal direction of the switch, which is exceedingly advantageous against the deterioration of the insulator. Furthermore, the heat suffered by the fixed contact 9 is transferred by conduction to the header plate 2 having a large heat capacity and accordingly, the temperature of the fixed contact 9 is rapidly decreased. This is advantageous in preventing wear of the fixed contact 9.

On the other hand, the heat suffered by the movable contact 8 is absorbed into the thermally responsive element 7. This effectively causes the temperature of the thermally responsive element 7 not to decrease within a predetermined period of time when the current ceases flowing into the circuit, resulting in extension of a switch off-state period between the time the thermally responsive element 7 reverses its curvature at 150° C. and the time it naturally returns to the former curvature state at 80° C. This is advantageous in improving the life of the thermally responsive switch repeating the on-state and off-state alternately as well as in restraining the rise in the motor temperature. Furthermore, when the heat of the thermally responsive element 7 is radiated via the support 5 and conductor 3, the portion of the thermally responsive element 5 where the aperture 5D is formed serves as a high temperature spot as the result that the electrical resistance is increased locally at that portion of the element 5. Also, the cross sectional area of that portion of the element 5 through which the heat is transferred is locally reduced. It is difficult for the heat of the thermally responsive element 7 to escape therefrom by a synergistic effect. Consequently, the off-state period of the thermally responsive switch can be further extended advantageously.

In accordance with the thermally responsive switch described above, the following effects can be achieved. Assembling the switching assembly including the header plate, the support secured at one end to the header plate, the thermally responsive element and movable and fixed contacts is completed before the final step where the hermetic casing is assembled. Consequently, the relative positions among the parts of the switching assembly can be readily checked and adjusted. In the conventional construction, however, it has been difficult to check and adjust the relative positions among the parts of the switching assembly since the thermally responsive element is secured to the receptacle itself composing the hermetic casing. Consequently, the relative positions among the parts of the switching assembly can be readily checked and adjusted.

The hermetic casing of the switch in accordance with the present invention has a high level of pressure tightness since the receptacle of the casing has the shape of an elliptic dome. Furthermore, since the distance between the contacts and the insulating filler can be increased, the particles of the contact material caused by the heat due to the electric arc can be prevented from adhering to the surface of the insulating filler for securing the conductor. Consequently, the insulating filler does not need too high level of either the heat resistance or the dielectric strength.

Furthermore, since the supporting portion of the support has a reduced cross sectional area, the electrical resistance is increased at the portion with the reduced cross sectional area and the cross sectional area of that portion through which the heat is transferred is also decreased when the heat of the thermally responsive element is radiated via the support and conductor. Accordingly, it is difficult for the heat of the thermally responsive element to escape therefrom by the synergistic effect. Consequently, the off-state period of the thermally responsive switch can be extended. This is advantageous in improving the life of the thermally responsive switch repeating the on-state and off-state alternately. Furthermore, the heat suffered by the fixed contact is transferred by conduction to the header plate having a large heat capacity and accordingly, the temperature of the fixed contact is rapidly decreased. This is advantageous in preventing wear of the fixed contact.

In the calibration of the operating temperature, a force has been conventionally applied to the vicinity of the end of the thermally responsive element where it is secured to the support. In the present invention, however, the force is applied via the calibrating member adjacent to the receptacle inner surface to the end of the support opposite to the end thereof where it is secured to the conductor. The application of the force to that support end is performed after the receptacle and header plate are combined into the hermetic casing. Since the support is deformed in the vicinity of the root portion of its fixed end, an amount of movement of its supporting portion to which the thermally responsive element is secured is smaller by leverage than an amount of movement of the calibrating member due to deformation of the receptacle. Consequently, the calibration of the operating temperature can be precisely performed by gradually increasing or decreasing the contact pressure of the movable contact relative to the fixed contact.

Figure 5:
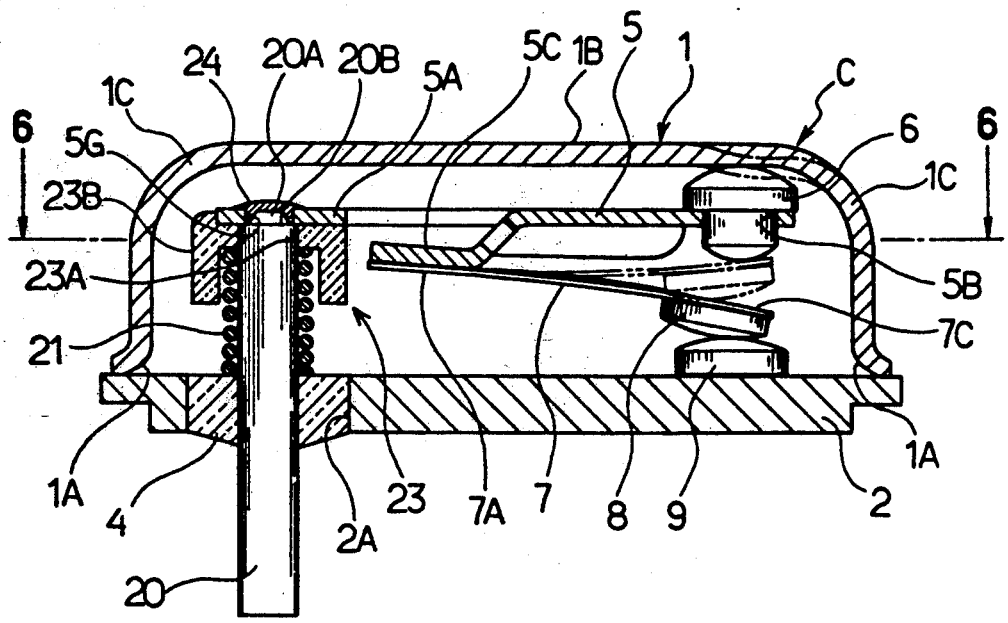
FIG. 5 is a view similar to FIG. 1 showing a modified form of the thermally responsive switch.
Figure 6:
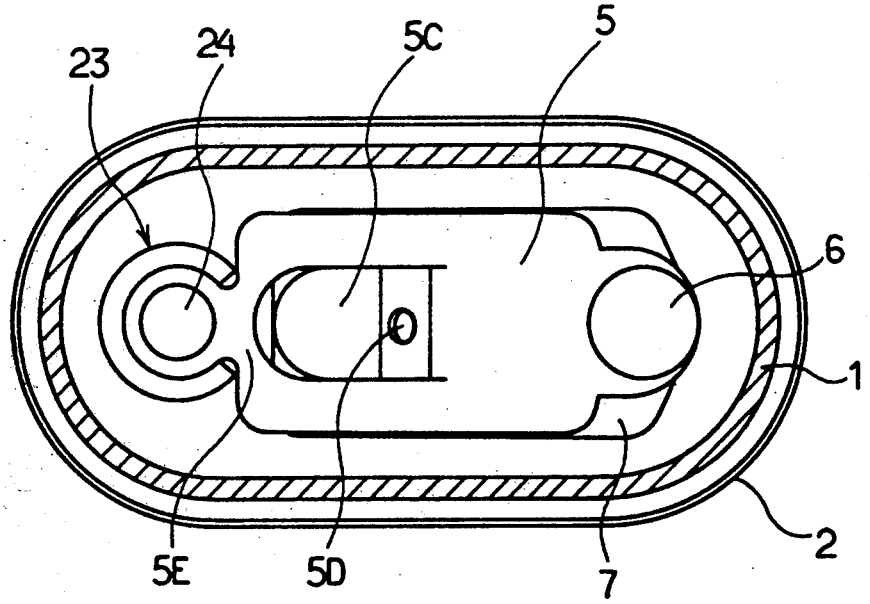
FIG. 6 is a view similar to FIG. 2 taken along line 6—6 in FIG. 5.
Figure 7:
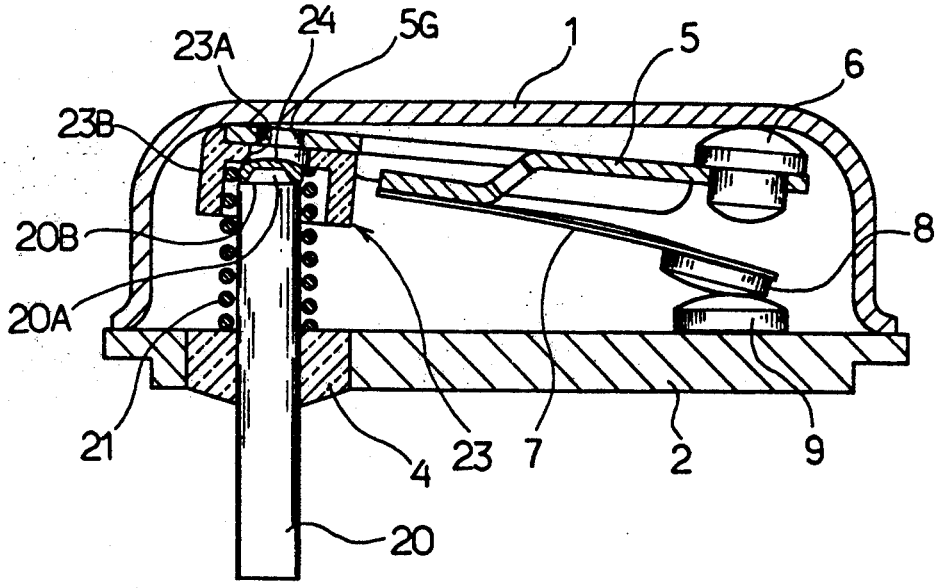
FIG. 7 is a view similar to FIG. 5 showing the state that the thermally responsive switch has responded to an abnormal temperature rise.

A modified form of the thermally responsive switch will be described with reference to FIGS. 5 to 7 in which figures like reference numerals are used to designate the like or similar parts shown in FIG. 1. An electrically conductive terminal pin 20 has a tapered fixing projection 20A on the end positioned in the hermetic casing. The maximum diameter of the fixing projection 20A is set to be smaller than the diameter of the terminal pin 20. The terminal pin 20 has a shoulder 20B at its maximum diameter portion. A spring 21 is mounted on the portion of the terminal pin 20 positioned in the hermetic casing. A cylindrical insulator 23 formed of ceramics or the like is attached to the terminal pin 20 for axial movement by inserting the pin into a central attachment aperture 23A of the insulator. The support 5 has a mounting hole 5G in the vicinity of its fixed portion 5A. The fixing projection 20A is fitted into the mounting hole 5G so that the support 5 is approximately perpendicular to the terminal pin 20 with the fixing portion 5A abutting against the shoulder 20B. The support 5 is secured to the terminal pin 20 by a conductive easily meltable material such as solder melted at a predetermined temperature. In this case the spring 21 is pressed to be compressed via the insulator 23 by the support 5 and retains an expansive force. In assembling the above-described parts, the spring 21 is first mounted on the terminal pin 20. The insulator 23 is then put on the upper end of the terminal pin 20 and the fixing projection 20A is inserted through the attachment aperture 23A. The fixing projection 20A of the terminal pin 20 is inserted into the mounting hole 5G of the support 5 in the condition that the spring 21 is compressed. The support 5 is positioned when the fixed portion 5A abuts against the shoulder 20B, and the support 5 is secured in position by the easily meltable material 24.

Although the support 5 is thus positioned by inserting the fixing projection 20A into the mounting hole 5G and abutting the fixed portion 5A against the shoulder 20B, mounting jigs may be employed to position the support 5. For example, the terminal pin 20 secured to the header plate 2 is attached to a first jig (not shown) and the support 5 to which the thermally responsive element 7 is secured is attached to a second jig (not shown). The first jig is then butted against the second jig so that the jigs are positioned in a predetermined positional relation, and the support 5 is secured to the terminal pin 20 by the easily meltable material 24. In this case the fixing projection 20A and mounting hole 5G are not necessarily provided.

In the above-described assembling step, heat is applied to the support 5 with a soldering iron at about 300° C. when it is soldered to the terminal pin 20. On the other hand, in the construction that the supporting portion of the support 5 where the thermally responsive element 7 is secured is directly soldered to the terminal pin 20, the temperature characteristic of the thermally responsive element 7 is changed as the result of heating in the soldering step to the extent that the change cannot be ignored. In the present invention, however, since the mounting hole 5G of the support 5 is apart from the supporting portion 5C by a relatively long distance, the thermally responsive element 7 is not substantially influenced by heating if it is performed for a normal working period. The thermally responsive element 7 is left in a heat treatment oven whose atmospheric temperature is at about 300° C. so that the reversing and resetting temperatures of the thermally responsive element are not changed for a long period of time. This effect of aging cannot be reduced by the heating when the support is secured to the terminal pin.

In the case where the motor is continuously in a so-called locked rotor condition, the thermally responsive element 7 is repeatedly reversed and reset alternately such that the movable contact 8 is repeatedly disengaged from and engaged with the fixed contact 9. Finally, the electric path is not opened even when the temperature of the thermally responsive element 7 reaches 150° C., as the result of fatigue of the element or the welding of the contacts. Consequently, the atmospheric temperatures of the motor housing interior and the switch casing interior are further raised. When the atmospheric temperature around the easily meltable material 24 reaches 180° C., for example, it melts or is softened such that it loses a securing force applied to the mounting hole 5G of the support 5 and the fixing projection 20A of the terminal pin 20. In this case, however, an expansive force of the spring 21 mounted on the terminal pin 20 via the insulator 23 separates the support 5 from terminal pin 20 to push the support against the receptacle inner wall such that the electric path is reliably cut off, as shown in FIG. 7. The insulator 23 has a cylindrical portion 23B covering and receiving the upper end of the spring 21. The cylindrical portion 23B of the insulator 23 prevents the terminal pin 20 from being engaged with the conductive member when the support 5 is separated from the terminal pin 20. The separation of the support 5 from the terminal pin 20 can cause the terminal pin 20 to be again brought into contact with the conductive member such as the support 5 directly or through the spring 21, resulting in reclosure of the electric path. However, the above-described arrangement of the insulator 23 effectively prevents the reclosure of the electric path.

The arrangement shown in FIG. 5 may be modified as follows. The spring 21 may be replaced by a shape memory alloy having a preset transition temperature (Curie point) so that the support fixed portion is not deformed during the normal running of the motor. The insulator 23 may be eliminated when the spring 21 is formed of an electrically insulative material such as elastic ceramics or a suitable heat resisting elastic resin. In addition to the solder as a lead-tin alloy, the easily meltable material 24 may be obtained by mixing some of tin, lead, bismuth and cadmium at a suitable rate. In this case the melting point of the mixture can be rendered lower than that of the solder 24. Furthermore, a synthetic resin or the like may be employed as the easily meltable material. In consideration of the temperature at which the synthetic resin or the like undergoes the thermal deformation, the shape of the synthetic resin before thermal deformation can be applied as a securing function which is reduced as the thermal deformation is initiated.

The foregoing disclosure and drawings are merely illustrative of the principles of the present invention and are not to be interpreted in a limiting sense. The only limitation is to be determined from the scope of the appended claims.

We claim:

1. A thermally responsive switch comprising:

a) an elliptic dome-shaped receptacle formed of a metallic material and having a generally arc-shaped central portion, two generally hemispheric ends and an open end;

b) a header plate formed of a metallic material and hermetically secured to the receptacle by way of welding so as to close the open end thereof such that a hermetic casing is formed by the receptacle and the header plate, the header plate having an aperture formed therethrough at one of two longitudinal ends;

c) an electrical conductor inserted through the aperture of the header plate so that both ends thereof are projected from both sides by predetermined dimensions respectively, the conductor being secured in the aperture with an electrically insulating material inserted between the peripheral wall surface of the aperture and the outer periphery of the conductor for hermetically sealing the enclosure in the casing;

d) a support disposed within the receptacle along the longitudinal direction thereof and having at one of two longitudinal ends a fixed portion secured to the end of the conductor and a supporting portion positioned away from the other end thereof in the direction of the fixed portion;

e) a thermally responsive element secured at one of two ends to the supporting portion of the support and carrying a movable contact at the other end, the thermally responsive element being formed of a thermally deformable material the thermally responsive element having a generally central shallow dish-shaped portion reversing its curvature with a snap action in response to an ambient temperature;

f) a fixed contact secured to the header plate in the vicinity of the other longitudinal end thereof for thermal conduction so as to cooperate with the movable contact; and g) a calibrating member interposed between the inner wall of the receptacle and the other end of the support opposing the movable contact, the calibrating member being moved, pushing the other end of the support when the receptacle wall corresponding to the calibrating member is deformed for calibration of an operating temperature of the thermally responsive switch, so that the support is bent in the vicinity of the fixed portion thereof such that a contact pressure between the movable and fixed contacts is varied.

2. A thermally responsive switch according to claim 1, wherein the header plate has a thickness which is larger than a wall thickness of the receptacle and the support has a smaller cross sectional area at the portion in the vicinity of the supporting portion than at the other portion thereof so that an electrical resistance and a thermal resistance is rendered larger at the portion in the vicinity of the supporting portion than in the other portion.

3. A method of making a thermally responsive switch comprising steps of:

a) forming an elliptic dome-shaped receptacle from a metallic material so that the receptacle includes a generally arc-shaped central portion, two generally hemispheric ends and an open end;

b) forming a header plate from a metallic material so that the header plate is hermetically secured to the receptacle by way of welding so as to close the open end thereof such that a hermetic casing is formed by the receptacle and the header plate, the header plate having an aperture formed therethrough at one of two longitudinal ends;

c) inserting a pin-shaped conductor through the aperture of the header plate so that both ends of the conductor are projected from both sides of the header plate by predetermined dimensions respectively, and securing the pin-shaped conductor in the aperture with an electrically insulating material inserted between the peripheral wall surface of the aperture and the outer periphery of the conductor for hermetically sealing the enclosure in the casing and a fixed contact to the header plate in the vicinity of the other longitudinal end thereof for thermal conduction;

d) forming a support having at one of two longitudinal ends a fixed portion and a supporting portion positioned away from the other end thereof in the direction of the fixed portion;

e) positioning a calibrating member to a portion of the support in the vicinity of the other end thereof;

f) forming a thermally responsive element from a thermally deformable material, the thermally responsive element carrying a movable contact at one end thereof and having a generally central shallow dish-shaped portion reversing its curvature with a snap action in response to an ambient temperature;

g) securing the other end of the thermally responsive element to the supporting portion of the support in a relation that the movable contact faces the other end of the support;

h) securing the fixed portion of the support to the end of the conductor projected toward the fixed contact disposition side so that the movable contact is retained in a relation of a proper cooperation with the fixed contact;

i) adjusting the movable contact after execution of the support fixed portion securing step so that the same is in contact with the fixed contact or maintains a predetermined range of space between the same and the fixed contact;

j) measuring or adjusting a space between predetermined portions of the movable contact and the calibrating member after execution of the support fixed portion securing step;

k) hermetically securing the header plate to the receptacle by way of welding so that the open end of the receptacle is closed by the header plate, that the side of the header plate on which the fixed contact is secured faces the inside of the receptacle and that the hermetic casing is provided, after execution of the movable contact adjusting step and the space measuring or adjusting step; and l) performing an operating temperature calibrating operation after execution of the header plate securing step, in which calibrating operation a portion of the receptacle wall corresponding to the calibrating member is deformed so that the calibrating member is moved, pushing the other end of the support with the deformation of the receptacle wall and that a contact pressure between the movable and fixed contacts is varied with bending of the support in the vicinity of the fixed portion thereof due to the pushing of the calibrating member against the other end of the support.

4. A thermally responsive switch wherein a movable contact is brought into contact with and departed from a fixed contact as the result of a snap action of a thermally responsive element in response to an ambient temperature, the switch comprising:

a) an elliptic dome-shaped receptacle formed of a metallic material and having a generally arc-shaped central portion, two generally hemispheric ends and an open end;

b) a header plate formed of a metallic material and hermetically secured to the receptacle by way of welding so as to close the open end thereof such that a hermetic casing is formed by the receptacle and the header plate, the header plate having an aperture formed therethrough at one of two longitudinal ends;

c) an electrically conductive terminal pin inserted through the aperture of the header plate so that both ends thereof are projected from both sides by predetermined dimensions respectively, the terminal pin being secured in the aperture with an electrically insulating material inserted between the peripheral wall surface of the aperture and the outer periphery of the terminal pin for hermetically sealing the enclosure in the casing;

d) a support disposed within the receptacle along the longitudinal direction thereof, the support having at one of two longitudinal ends a fixed portion secured to the end of the terminal pin positioned in the receptacle and a supporting portion supporting the thermally responsive element, the supporting portion being positioned away from the other end of the support in the direction of the fixed portion; and e) an easily meltable member fixedly coupling between an end of the terminal pin positioned inside the hermetic casing and the fixed portion of the support, the easily meltable member having a melting or softening temperature higher than the temperature at which the thermally responsive element is operated with the snap action.

5. A thermally responsive switch according to claim 4, wherein the fixed portion of the support is secured to the terminal pin by the easily meltable member after the thermally responsive element is secured to the supporting portion of the support.

6. A thermally responsive switch according to claim 4, which further comprises a spring member provided in the hermetic casing for urging the thermally responsive element in the direction that the supporting portion of the support is departed from the terminal pin.

7. A thermally responsive switch according to claim 6, wherein the spring member is formed of an electrically insulative elastic material.

8. A thermally responsive switch according to claim 6, wherein the spring member is formed of a shape memory alloy.

* * * * *